US008813311B2

(12) United States Patent
Li

(10) Patent No.: US 8,813,311 B2
(45) Date of Patent: Aug. 26, 2014

(54) HINGE MECHANISM

(71) Applicant: Hon Hai Precision Industry Co., Ltd., New Taipei (TW)

(72) Inventor: Hsiao-Wu Li, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/898,980

(22) Filed: May 21, 2013

(65) Prior Publication Data

US 2014/0026362 A1 Jan. 30, 2014

(30) Foreign Application Priority Data

Jul. 27, 2012 (TW) ..... 101127370 A

(51) Int. Cl.
*E05F 1/08* (2006.01)

(52) U.S. Cl.
USPC ..... 16/286; 16/325; 16/326; 16/327

(58) Field of Classification Search
CPC ..... E05F 1/1253; E05F 1/1276; E05F 5/006; E05D 11/105; E05D 11/1007; E05D 11/1014; E05D 11/1021; F16C 11/10; A45C 13/005
USPC ..... 16/286, 287, 294, 296, 303, 311, 312, 16/325, 326, 327, 335
See application file for complete search history.

(56) References Cited

U.S. PATENT DOCUMENTS

| | | | | |
|---|---|---|---|---|
| 2,903,149 | A * | 9/1959 | Turner | 217/60 E |
| 5,937,481 | A * | 8/1999 | Faringosi | 16/332 |
| 7,610,656 | B2 * | 11/2009 | Vanini | 16/286 |
| 7,676,888 | B2 * | 3/2010 | Vanini | 16/286 |
| 7,798,541 | B2 * | 9/2010 | Hirtsiefer | 292/262 |
| 8,413,301 | B2 * | 4/2013 | Fang | 16/286 |
| 2007/0199178 | A1 * | 8/2007 | Katsumata | 16/286 |
| 2009/0064457 | A1 * | 3/2009 | Brustle | 16/292 |
| 2010/0236021 | A1 * | 9/2010 | Sir Louis | 16/303 |

* cited by examiner

*Primary Examiner* — Robert A Delisle
(74) *Attorney, Agent, or Firm* — Novak Druce Connolly Bove + Quigg LLP

(57) ABSTRACT

A hinge mechanism includes a housing, a spring member, a slider, a rotating member and a connecting rod. The slider is located on the spring member. The slider is movable along a straight line driven by the spring member. The rotating member is rotatable about a pin of the housing. The connecting rod provides a separation linkage between the slider and the rotating member to reduce friction and to render torque and counter-torque calculations easier in the context of establishing a resting position for the hinge mechanism.

17 Claims, 4 Drawing Sheets

HINGE MECHANISM

BACKGROUND

1. Technical Field

The disclosure generally relates to hinge mechanisms, especially to a free-stop hinge mechanism.

2. Description of Related Art

Referring to FIG. 4, a traditional hinge includes a cam 100, a spring 300, and a slider 200 which can be driven by the spring 300. The cam 100 contacts a top curved surface of the slider 200. The cam 100 presses down the slider 200. The cam 100 can be preloaded with torque to stop in any desired position. However, when the cam 100 presses down the slider 200, a contact surface between the cam 100 and the slider 200 changes, and a direction of a force exerted on the slider 200 changes. Thus, particularly because of friction, it is hard to calculate the desired torque to be preloaded into the cam 100. There is room to improve within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
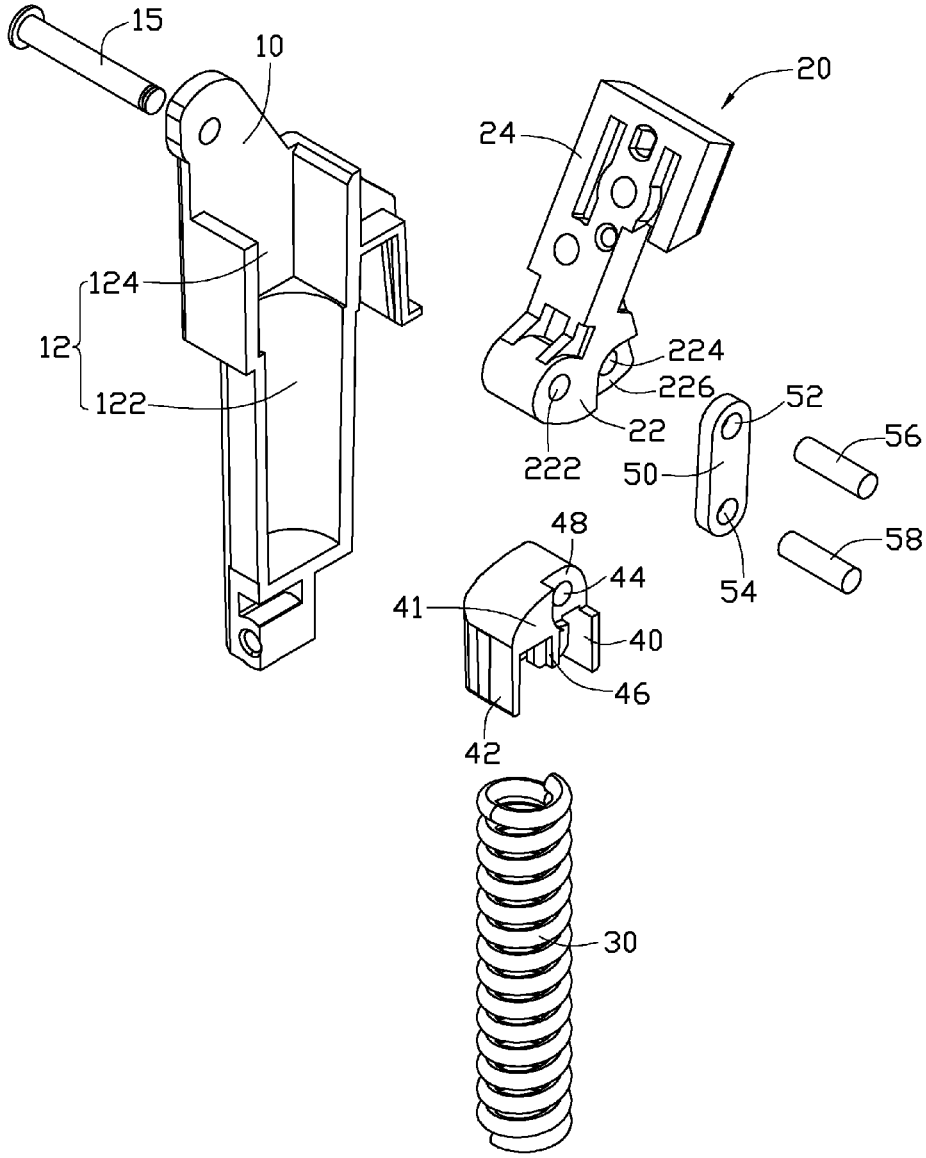
FIG. 1 is an exploded, isometric view of a hinge mechanism in one embodiment.

FIG. 1 illustrates one embodiment of a hinge mechanism. The hinge mechanism includes a housing 10, a spring member 30, a slider 40 located on the spring member 30, a rotating member 20, and a connecting rod 50.

The housing 10 defines a receiving room 12. The receiving room 12 includes a spring room 122 and a slide room 124. A cross section of the spring room 122 is substantially circular. A cross section of the slide room 124 is substantially rectangular. A cross section area of the spring room 122 is greater than a cross section area of the slide room 124.

The rotating member 20 is rotatable about a pin 15 on the housing 10. The rotating member 20 includes a cam 22 and a straight arm 24. The cam 22 has an arcuate outer surface. A first recess 226, a first mounting hole 222 and a first pivot hole 224 are defined in the cam 22. The first pivot hole 224 is defined in the first recess 226. The straight arm 24 extends out from a point between the first mounting hole 222 and the first pivot hole 224. The first mounting hole 222 and the first pivot hole 224 are located on opposite sides of a lengthwise centerline line through the straight arm 24.

The spring member 30 is deformable in the spring room 122. The spring member 30 may be, for example, a coil spring.

The slider 40 functions as a cap or end piece over the spring member 30 and includes a driving portion 41, an engaging portion 46 to engage with the spring member 30, and a supporting portion 42 extending down from an outer edge of the driving portion 41. A second recess 48 and a second pivot hole 44 are defined in the driving portion 41. The second pivot hole 44 is defined in the second recess 48.

The connecting rod 50 provides a linkage between the rotating member 20 and the slider 40. The connecting rod 50 defines a first through hole 52 and a second through hole 54. The connecting rod 50 is straight and has two rounded ends. The connecting rod 50 is free to rotate about the rotating member 20 at a first pivot shaft 56 and about the slider 40 at a second pivot shaft 58.

Figure 2:
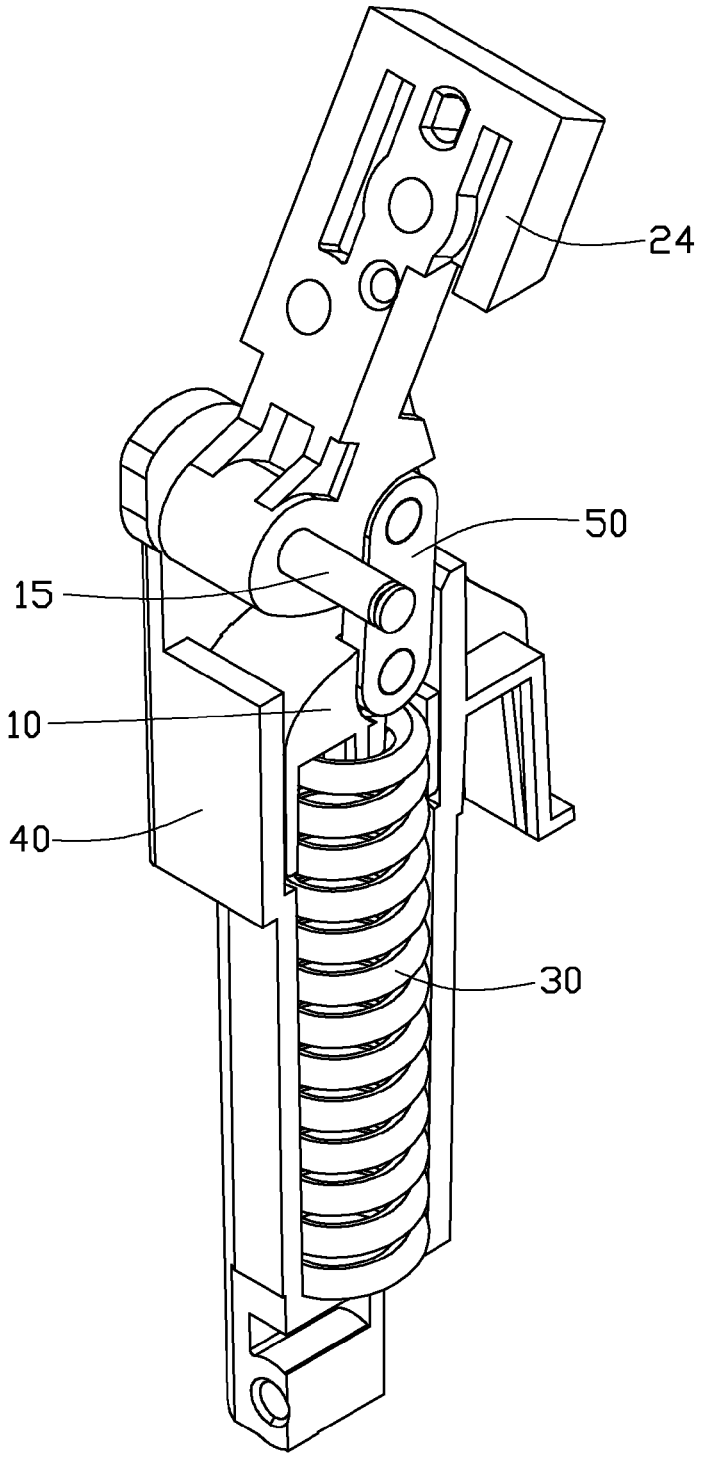
FIG. 2 is an assembled view of the hinge mechanism of FIG. 1.
Figure 3:
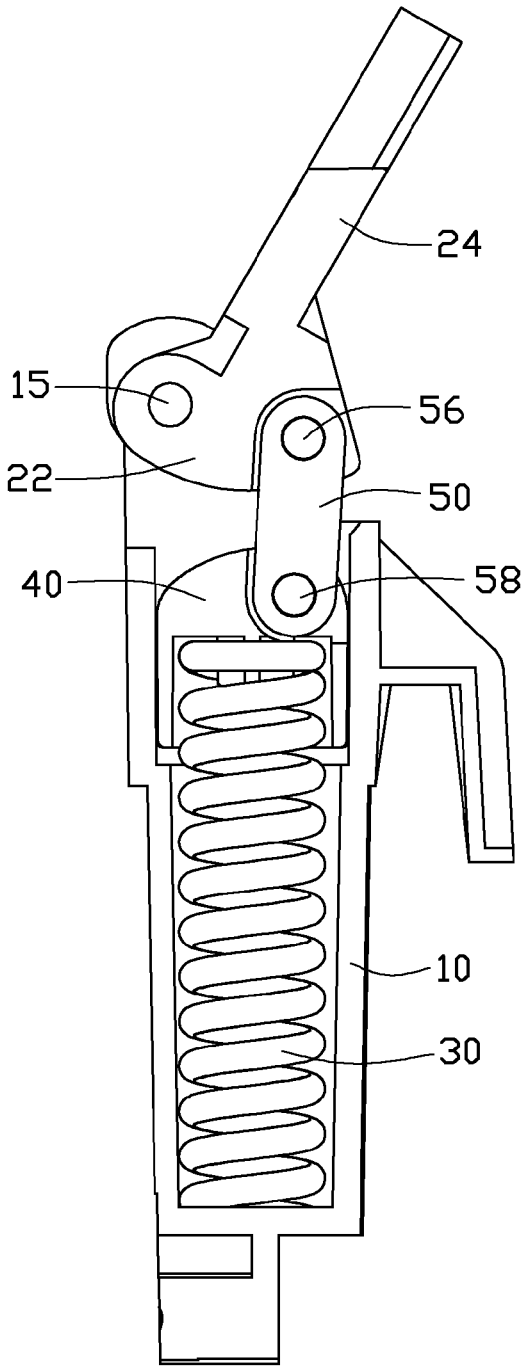
FIG. 3 is a front view of the hinge mechanism of FIG. 2.
Figure 4:
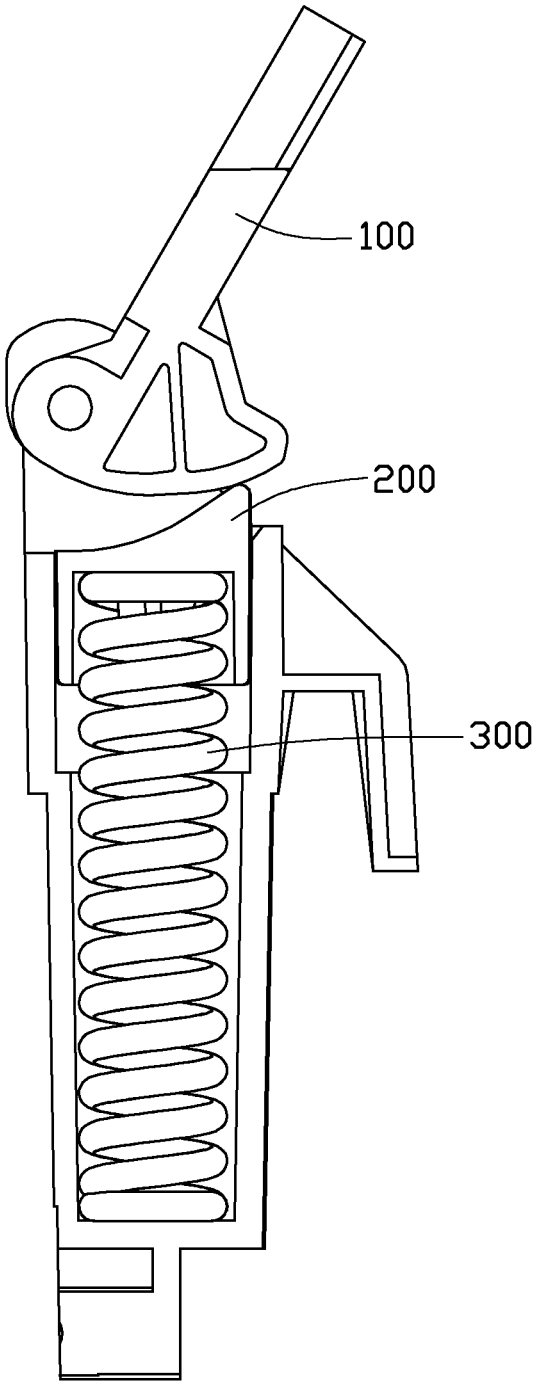
FIG. 4 (PRIOR ART)
FIG. 4 is a front view of a hinge mechanism of the prior art.

Referring to FIG. 2 and FIG. 3, the spring member 30 is positioned in the spring room 122. The engaging portion 46 of the slider 40 engages with the spring member 30. The slider 40 is slidable in the slide room 124 driven by the spring member 30. The rotating member 20 is pivoted to the housing 10 about the pin 15. An angle of the rotating member 20 is adjustable in mounting the connecting rod 50. The connecting rod 50 pivots about the first pivot shaft 56 and pivots about the second pivot shaft 58. Opposite ends of the connecting rods 50 are received in the first recess 226 and the second recess 48. The connecting rod 50 causes a certain distance to be always maintained between the rotating member 20 and the slider 40.

In use, when the rotating member 20 rotates down, the slider 40 moves down driven by the connecting rod 50. The spring member 30 is compressed and exerts a counter-force to the slider 40 and the rotating member 20. The gravity-based torque on the straight arm 24 is equal to a counter-torque exerted by the spring member 30 on rotating member 20.

The torque required on the rotating member 20 and the counter-torque from the slider 40 are easy to calculate due to the linkage geometry of the connecting rod 50. Thus, weight and shape of the rotating member 20 and any components attached thereto can be precisely manufactured.

It is to be understood, however, that even though numerous characteristics and advantages have been set forth in the foregoing description of embodiments, together with details of the structures and functions of the embodiments, the disclosure is illustrative only and changes may be made in detail, especially in the matters of shape, size, and arrangement of parts within the principles of the disclosure to the full extent indicated by the broad general meaning of the terms in which the appended claims are expressed.

What is claimed is:

1. A hinge mechanism comprising:

a housing;

a spring member located in the housing;

a slider located on the spring member and being movable along a straight line driven by the spring member;

a rotating member rotatable about a pin of the housing; and a connecting rod providing a linkage between the slider and the rotating member; wherein a first recess is defined in the rotating member, a second recess is defined in the slider, and the connecting rod is received in the first recess and the second recess.

2. The hinge mechanism of claim 1, wherein the connecting rod is rotatable about a first shaft, relative to the rotating member, and the first shaft is located on a side of the pin.

3. The hinge mechanism of claim 2, wherein the connecting rod is rotatable about a second shaft, relative to the slider; and a first angle defined between the straight line and a first line, which connects the pin and the second shaft, is larger than a second angle defined between the straight line and a second line, which connects the first shaft and the second shaft.

4. The hinge mechanism of claim 3, wherein the rotating member comprises a cam and a straight arm, the pin and the first shaft extends through the cam, and the pin and the first shaft are located on opposite sides of a lengthwise centerline through the straight arm.

5. The hinge mechanism of claim 4, wherein a gravity torque of the straight arm is equal to a counter-torque from the slider exerted by the spring member.

6. The hinge mechanism of claim 1, wherein the spring member is a coil spring.

7. The hinge mechanism of claim 1, wherein the housing defines a receiving room, and the receiving room comprises a spring room, receiving the spring member, and a slide room, receiving the slider.

8. The hinge mechanism of claim 7, wherein a cross section of the spring room is substantially circled, and a cross section of the slide room is substantially rectangular.

9. The hinge mechanism of claim 8, wherein a cross section area of the spring room is greater than a cross section area of the slide room.

10. A hinge mechanism comprising:

a housing;

a spring member located in the housing;

a slider located on the spring member and being movable along a straight line driven by the spring member;

a rotating member rotatable relative to the housing; and a connecting rod providing a linkage between the slider and the rotating member and cause a certain distance away between the rotating member and the slider; wherein the rotating member is rotatable about a pin, the connecting rod is rotatable about a first shaft, relative to the rotating member, and the first shaft is located on a side of the pin; the connecting rod is rotatable about a second shaft, relative to the slider; and the a first angle between a straight line and a first line connecting the pin and the second shaft is larger than a second angle between the straight line and a second line connecting the first shaft and the second shaft.

11. The hinge mechanism of claim 10, wherein the rotating member comprises a cam and a straight arm, the pin and the first shaft extends through the cam, and the pin and the first shaft are located on opposite sides of a lengthwise centerline through the straight arm.

12. The hinge mechanism of claim 11, wherein a gravity torque of on the straight arm is equal to a counter-torque from the slider exerted by the spring member.

13. The hinge mechanism of claim 10, wherein the spring member is a coil spring.

14. The hinge mechanism of claim 10, wherein the housing defines a receiving room, and the receiving room comprises a spring room, for receiving the spring member, and a slide room, for receiving the slider.

15. The hinge mechanism of claim 14, wherein a cross section of the spring room is substantially circled, and a cross section of the slide room is substantially rectangular.

16. The hinge mechanism of claim 15, wherein a cross section area of the spring room is greater than a cross section area of the slide room.

17. The hinge mechanism of claim 10, wherein a first recess is defined in the rotating member, a second recess is defined in the slider, and the connecting rod is received in the first recess and the second recess.

* * * * *